US008282408B1

(12) United States Patent
Chou et al.

(10) Patent No.: US 8,282,408 B1
(45) Date of Patent: Oct. 9, 2012

(54) LAMP HOLDER STRUCTURE FOR LAMP-TUBES IN SERIAL CONNECTIONS

(75) Inventors: Chia-Te Chou, New Taipei (TW); Shih-Jen Chuang, New Taipei (TW)

(73) Assignee: Ecolighting, Inc Corp., New Taipei (TW)

( * ) Notice: Subject to any disclaimer, the term of this patent is extended or adjusted under 35 U.S.C. 154(b) by 0 days.

(21) Appl. No.: 13/229,657

(22) Filed: Sep. 9, 2011

(51) Int. Cl.
*H01R 33/08* (2006.01)
*H01R 33/00* (2006.01)

(52) U.S. Cl. ..... 439/226; 362/649; 362/652

(58) Field of Classification Search ..... 362/649, 362/652; 439/226, 239–244
See application file for complete search history.

(56) References Cited

U.S. PATENT DOCUMENTS 2,292,043 A * 8/1942 Bryant ..... 439/240
2,313,036 A * 3/1943 Burt ..... 439/240
2,767,349 A * 10/1956 Feinberg ..... 439/240
6,561,828 B2 * 5/2003 Henrici et al. ..... 439/239
8,038,458 B2 * 10/2011 Tufano et al. ..... 439/239

* cited by examiner

*Primary Examiner* — Briggitte R Hammond
(74) *Attorney, Agent, or Firm* — Chun-Ming Shih; HDLS IPR Services

(57) ABSTRACT

A lamp holder structure includes a base body, two electrode plates, a rotary shaft, a short-circuit part, and a cover. When multiple sets of lamp holder structures are used in serial connections, a shaft part of the rotary shaft is rotated by rotating a lamp-tube for the lamp holder structure. Conducting terminals of the lamp-tube are electrically contacted with the two electrode plates. Before rotating the lamp-tube, the short-circuit part is electrically contacted with the two electrode plates. After rotating the lamp-tube, the short-circuit part is electrically contacted with one of the two electrode plates. The electrical connection between the two electrode plates is achieved by the lamp-tube. When the lamp-tube is removed, the lamp-tube is rotated again, so that the short-circuit part is electrically contacted with the two electrode plates, and the two electrode plates are short-circuited. The power could be transmitted to the next lamp holder structure.

11 Claims, 7 Drawing Sheets

LAMP HOLDER STRUCTURE FOR LAMP-TUBES IN SERIAL CONNECTIONS

BACKGROUND OF THE INVENTION

1. Field of the Invention

The present invention relates to a lamp holder structure, and especially relates to a lamp holder structure for lamp-tubes in serial connections.

2. Description of Prior Art

It is well known that compared with the conventional bulbs, the light-emitting diodes have the merits of small volume, long life, low driving voltage, fast response, good shock resistance, colorful, and no image sticking. Therefore, the light-emitting diodes are used in light-emitting diode bulbs or light-emitting diode lamp-tubes. When the conventional light-emitting diode lamp-tubes are used, according to the place where the conventional light-emitting diode lamp-tubes are used, multiple sets of light-emitting diode lamp-tubes are serially connected to achieve the requiring illumination brightness.

When the conventional light-emitting diode lamp-tubes 201 are serially connected, a driver 20 is serially connected to multiple sets of light-emitting diode lamp-tubes 201. Two conducting terminals 202 of the light-emitting diode lamp-tube 201 are electrically connected to two electrode plates 302 inside a lamp holder structure 30. When the power is on, the power transmission between the two electrode plates 302 is through the light-emitting diode lamp-tube 201. When the light-emitting diode lamp-tube 201 is removed or broken, between the two electrode plates 302 will be an open loop 301 (as shown in the FIG. 1A and FIG. 1B). The power cannot be transmitted to the next lamp holder structure 30, so that the next light-emitting diode lamp-tube 201 or the light-emitting diode lamp-tubes 201 in the rear cannot be lightened.

Users have to replace the broken light-emitting diode lamp-tube 201 with new light-emitting diode lamp-tube 201, so that the power can be transmitted to the next light-emitting diode lamp-tube 201 or the light-emitting diode lamp-tubes 201 in the rear. However, it is inconvenient.

SUMMARY OF THE INVENTION

In order to solve the above-mentioned problems, an object of the present invention is to provide a lamp holder structure for lamp-tubes in serial connections. A short-circuit part is arranged in the lamp holder structure. When the light-emitting diode lamp-tube is removed or broken, the two electrode plates inside the lamp holder structure will be short-circuited because of the short-circuit part. Therefore, the power can be transmitted to the next light-emitting diode lamp-tube, so that the light-emitting diode lamp-tubes in the rear can be lightened.

In order to achieve the object of the present invention mentioned above, the lamp holder structure for lamp-tubes in serial connections is to assemble with a lamp-tube having conducting terminals. The lamp holder structure includes a base body, two electrode plates, a rotary shaft, and a short-circuit part. The base body includes a via hole. The via hole includes a longitudinal opening. The electrode plates are arranged inside the base body. The electrode plate at least includes a first contact part around the via hole. The rotary shaft includes a barrier plate. A shaft part in the via hole is on the barrier plate. The shaft part and the barrier plate have a longitudinal gap. The short-circuit part is assembled with the shaft part.

The conducting terminals of the lamp-tube are arranged in the longitudinal gap through the longitudinal opening. The shaft part of the rotary shaft is rotated by rotating the lamp-tube, so that the conducting terminals of the lamp-tube are electrically contacted with the two first contact parts. Before rotating the lamp-tube, the short-circuit part is electrically contacted with the two electrode plates. After rotating the lamp-tube, the short-circuit part is electrically contacted with one of the two electrode plates, and the electrical connection between the two electrode plates is achieved by the lamp-tube. After rotating the lamp-tube again, the short-circuit part is electrically contacted with the two electrode plates, so that the two electrode plates are electrically contacted, and the power is transmitted to the next lamp holder structure.

The base body includes a bottom part. A housing is extended from the bottom part. The housing includes a round junction area. The junction area is arranged around the via hole. A plurality of longitudinal and lateral convex rib sheets, which are used to fix the two electrode plates, and a junction part are arranged inside the housing and below the via hole.

The first contact part is round. A first extension part is extended from the first contact part. A second extension part, which is inclined to the first extension part, is extended and bent from the first extension part. A conjunction part is in the shaft part. The conjunction part includes a pass-through hole. The shaft part is passed through by the pass-through hole. The shaft part includes a lateral gap. Two symmetric and half-round convex parts are inside the shaft part.

The short-circuit part is a semicircle arc sheet body. The short-circuit part includes a locking part, which is locked to the longitudinal gap of the shaft part. Each side of the short-circuit part is a buckling part. The buckling parts are buckled to the lateral gap of the shaft part.

The lamp holder structure further includes a cover, which covers the housing. The cover includes a convex block. The convex block includes an undulating edge part. The rotary shaft is assembled with the cover through the via hole. The convex part of the rotary shaft is on the edge part. A pivot axis is on the convex block. A convex-wall part in front of the pivot axis is in the conjunction part after the pass-through hole of the shaft part is passed through by the pivot axis. The cover includes at least a detent part and a fastening part. The detent part is used to detent the two first extension parts of the two electrode plates when the cover is assembled with the housing. The fastening part is used to fasten to the junction part.

DETAILED DESCRIPTION OF THE INVENTION

Figure 1B:
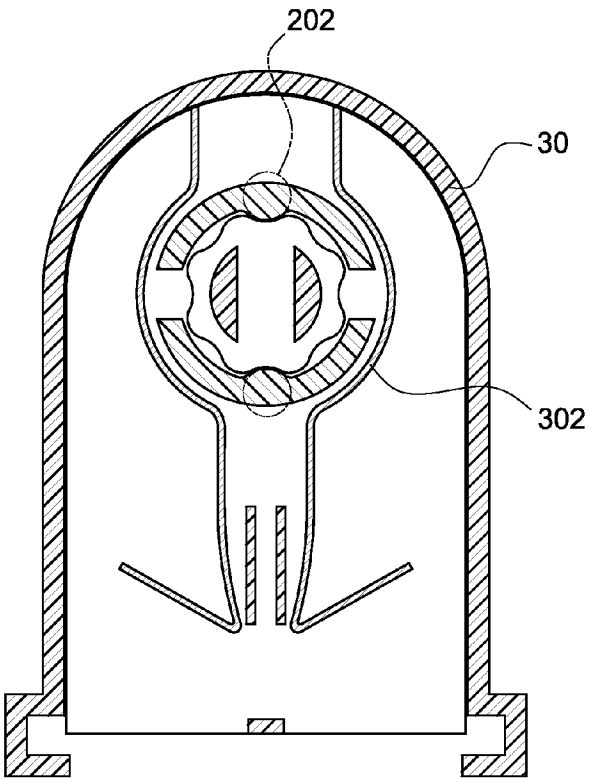
FIG.1B (Prior Art)
FIG. 1B shows a sectional view of the conventional lamp holder structure.
Figure 1A:
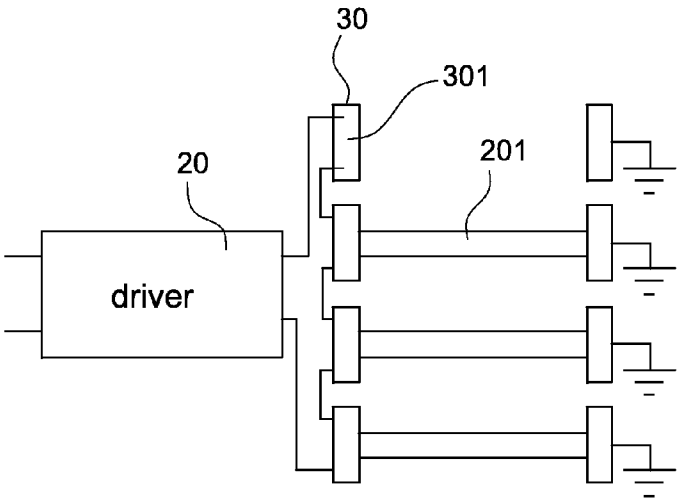
FIG.1A (Prior Art)
FIG. 1A shows a circuit diagram of the conventional light-emitting diode lamp-tubes in serial connections.
Figure 2:
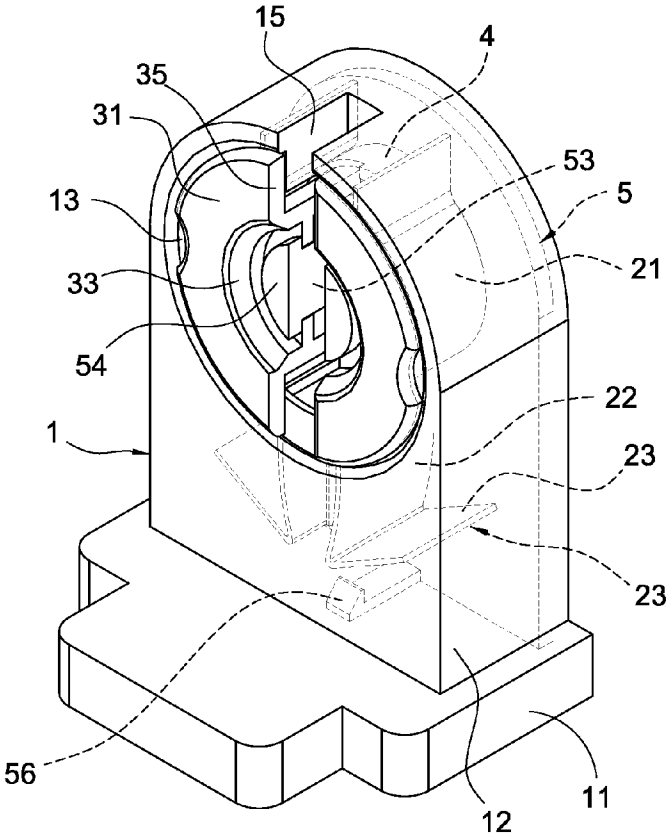
FIG. 2 shows a perspective view of the lamp holder structure of the present invention.
Figure 3:
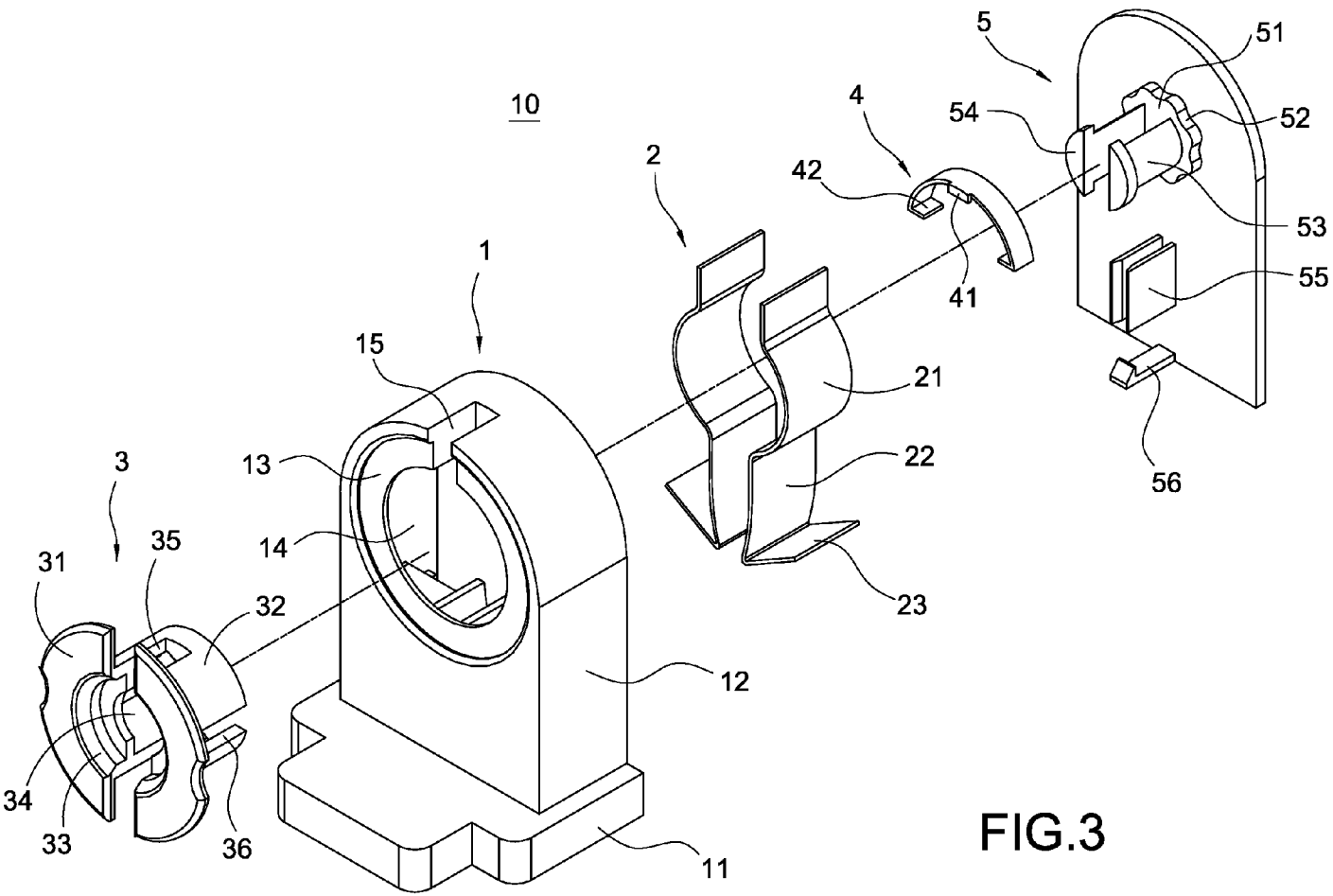
FIG. 3 shows an exploded view of the lamp holder structure of the present invention.
Figure 4:
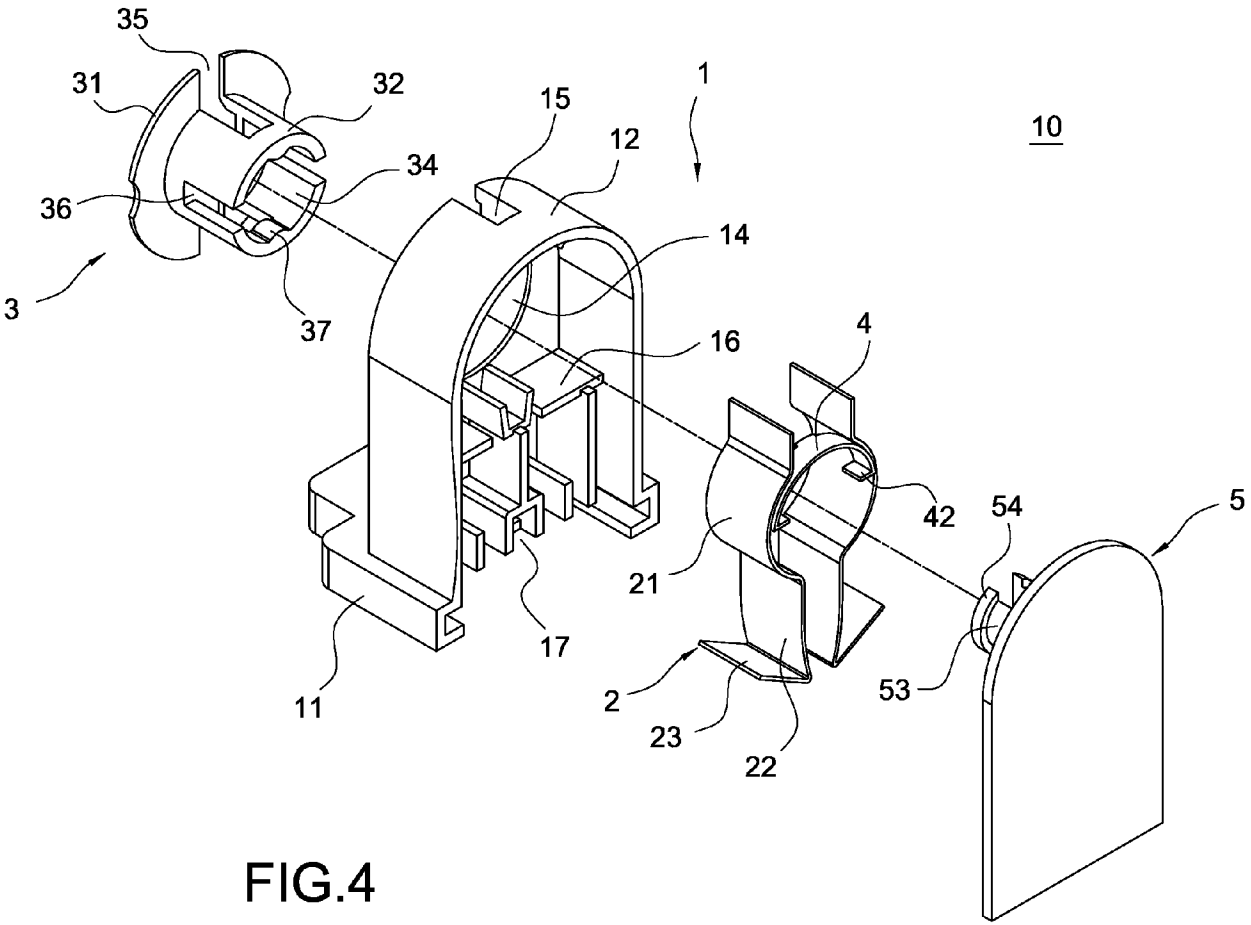
FIG. 4 shows another exploded view of the lamp holder structure of the present invention.

Regarding the technology and the detailed description of the present invention, now describe with diagrams as below:

FIG. 2 shows a perspective view of the lamp holder structure of the present invention. FIG. 3 shows an exploded view of the lamp holder structure of the present invention. FIG. 4 shows another exploded view of the lamp holder structure of the present invention.

As shown in the FIGS. 2 to 4, the lamp holder structure 10 of the present invention includes a base body 1, two electrode plates 2, a rotary shaft 3, a short-circuit part 4, and a cover 5.

The base body 1 includes a bottom part 11. A housing 12 is extended from the bottom part 11. The housing 12 includes a round junction area 13. The junction area 13 includes a via hole 14. The junction area 13 and the via hole 14 includes a longitudinal opening 15. A plurality of longitudinal and lateral convex rib sheets 16 and a junction part 17 are arranged inside the housing 12 and below the via hole 14. The convex rib sheets 16 are used to fix the two electrode plates 2.

The electrode plates 2 are arranged inside the housing 12. The electrode plate 2 includes an arc-shaped first contact part 21 around the via hole 14. A first extension part 22 is extended from the first contact part 21. A second extension part 23, which is inclined to the first extension part 22, is extended and bent from the first extension part 22. The first contact part 21 is around the via hole 14 inside the housing 12 when the first contact part 21 is assembled with the longitudinal and lateral convex rib sheets 16. Moreover, the second extension part 23 is electrically connected to the next lamp holder structure 10 with wires (not shown in the figures).

The rotary shaft 3 includes a round barrier plate 31 rotating on the junction area 13. A shaft part 32 is at one side of the barrier plate 31. The shaft part 32 includes a conjunction part 33. The conjunction part 33 includes a pass-through hole 34. The shaft part 32 is passed through by the pass-through hole 34. The shaft part 32 and the barrier plate 31 have a longitudinal gap 35. The shaft part 32 includes a lateral gap 36. Two symmetric and half-round convex parts 37 are inside the shaft part 32.

The short-circuit part 4 is a semicircle arc sheet body to assemble with the shaft part 32 of the rotary shaft 3. The short-circuit part 4 includes a locking part 41, which is locked to the longitudinal gap 35 of the shaft part 32. Each side of the short-circuit part 4 is a buckling part 42. The buckling parts 42 are buckled to the lateral gap 36 of the shaft part 32, so that the short-circuit part 4 is fixed firmly on the shaft part 32.

The cover 5 is used to cover the housing 12. The cover 5 includes a convex block 51. The convex block 51 includes an undulating edge part 52. The convex part 37 of the rotary shaft 3 is on the edge part 52 when the rotary shaft 3 is assembled with the cover 5 through the via hole 14. The convex part 37 is used to slide and fix with the edge part 52 when the rotary shaft 3 is rotated.

Moreover, a pivot axis 53 is on the convex block 51. A convex-wall part 54 in front of the pivot axis 53 is in the conjunction part 33 after the pass-through hole 34 of the shaft part 32 is passed through by the pivot axis 53, so that the rotary shaft 3 is not easily loosened. Besides, the cover 5 includes at least a detent part 55 and a fastening part 56. The detent part 55 is used to detent the two first extension parts 22 of the two electrode plates 2 when the cover 5 is assembled with the housing 12. The fastening part 56 is used to fasten to the junction part 17, so that the cover 5 is assembled firmly with the housing 12.

Figure 5:
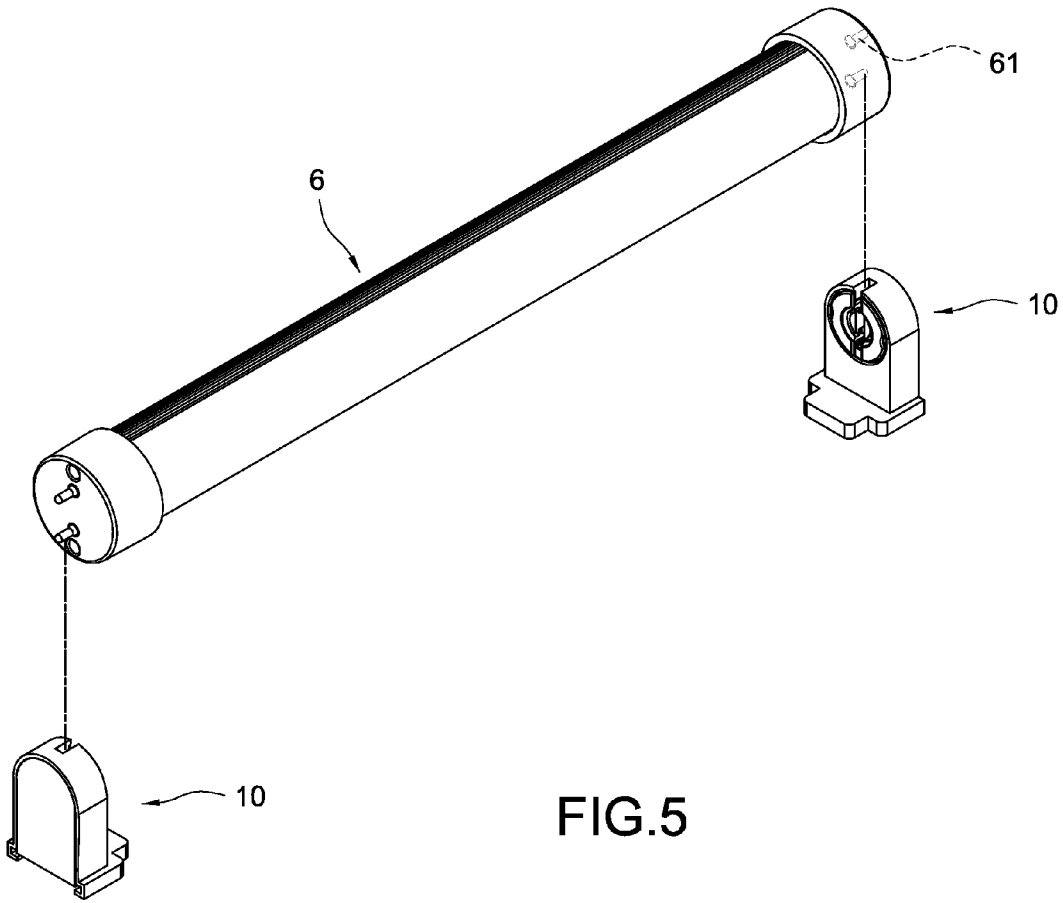
FIG. 5 shows a diagram of the combination of the lamp-tube and the lamp holder structure of the present invention.
Figure 7:
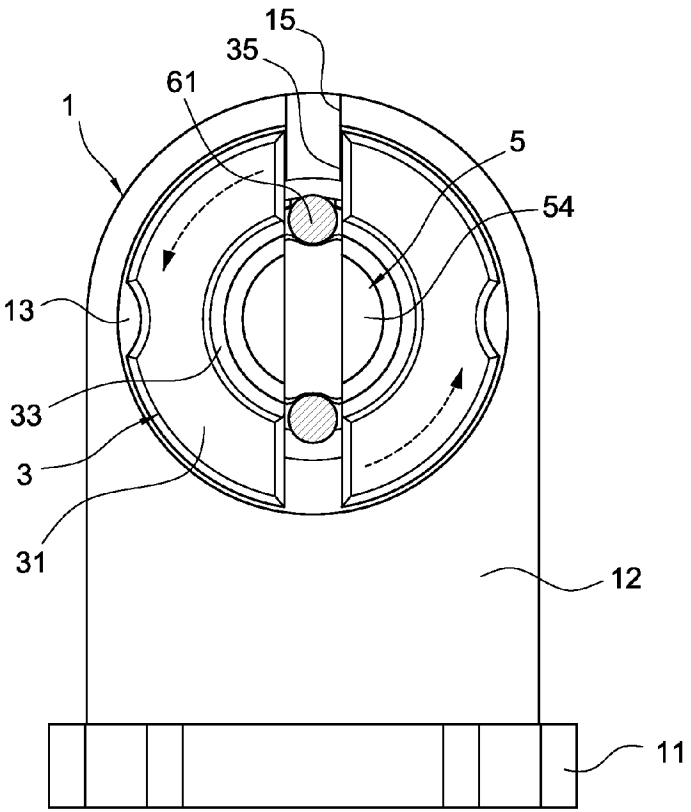
FIG. 7 shows a sectional view of the second process of the assembly of the lamp-tube and the lamp holder structure of the present invention.
Figure 6:
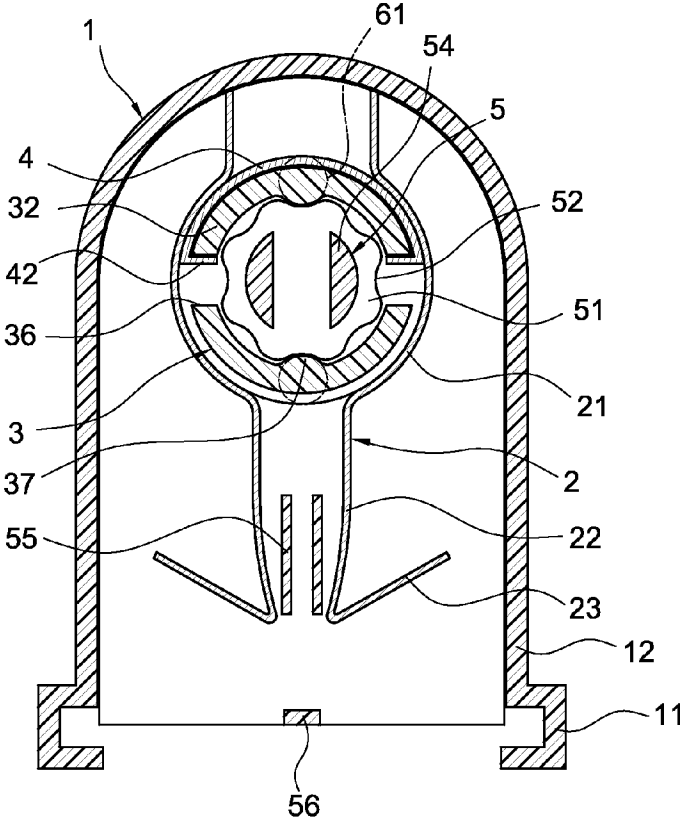
FIG. 6 shows a sectional view of the first process of the assembly of the lamp-tube and the lamp holder structure of the present invention.
Figure 8:
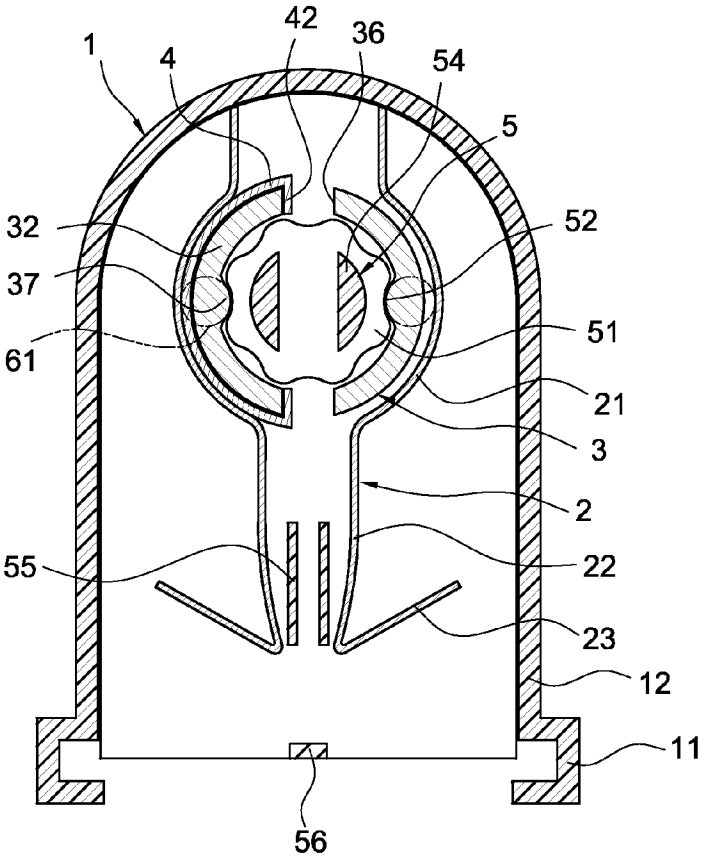
FIG. 8 shows a sectional view of the third process of the assembly of the lamp-tube and the lamp holder structure of the present invention.

FIG. 5 shows a diagram of the combination of the lamp-tube and the lamp holder structure of the present invention. FIG. 6 shows a sectional view of the first process of the assembly of the lamp-tube and the lamp holder structure of the present invention. FIG. 7 shows a sectional view of the second process of the assembly of the lamp-tube and the lamp holder structure of the present invention. FIG. 8 shows a sectional view of the third process of the assembly of the lamp-tube and the lamp holder structure of the present invention.

As shown in the figures, the shaft part 32 of the rotary shaft 3 is between the two first contact parts 21 after the base body 1, the two electrode plates 2, the rotary shaft 3, the short-circuit part 4, and the cover 5 are assembled. The short-circuit part 4 is electrically contacted with the two first contact parts 21, so that the two electrode plates 2 are electrically connected. Two conducting terminals 61 of the lamp-tube 6 are arranged in the longitudinal gap 35 of the rotary shaft 3 through the longitudinal opening 15 of the housing 12 when the lamp-tube 6 is assembled with the lamp holder structure 10. The barrier plate 31 is pushed by the conducting terminals 61 of the lamp-tube 6 to rotate the shaft part 32. The conducting terminals 61 of the lamp-tube 6 are electrically contacted with the first contact parts 21 of the electrode plates 2 when the shaft part 32 is rotated. The electrical connection between the two electrode plates 2 is achieved by the lamp-tube 6 after the short-circuit part 4 is rotated to contact with one of the first contact parts 21.

When the lamp-tube 6 is required to replace or the lamp-tube 6 is broken, by rotating the lamp-tube 6, the longitudinal gap 35 of the rotary shaft 3 corresponding to the longitudinal opening 15 of the housing 12, the lamp-tube 6 could be removed. In the meantime, the first contact parts 21 of the two electrode plates 2 are electrically contacted because of the short-circuit part 4, so that the power could be transmitted to the lamp holder structures 10 in the rear, and the lamp-tubes 6 in the rear could be lightened. Therefore, if one of the lamp-tubes 6 is broken or removed, the situation that the lamp-tubes 6 in the rear could not be lightened will not happen.

Figure 9:
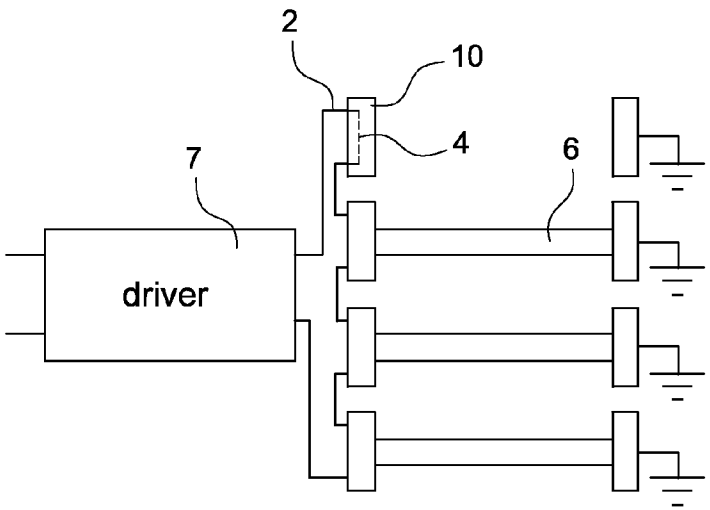
FIG. 9 shows a circuit diagram of the lamp-tube and the lamp holder structure of the present invention in serial connections.

FIG. 9 shows a circuit diagram of the lamp-tube and the lamp holder structure of the present invention in serial connections. As shown in the FIG. 9, a driver 7 is electrically connected to multiple sets of lamp-tubes 6. The first lamp holder structure 10 has no lamp-tube 6, but the two electrode plates 2 are electrically connected because of the short-circuit part 4. Therefore, the power could be transmitted to the lamp holder structures 10 in the rear, and the lamp-tubes 6 in the rear could be lightened. In the FIG. 9, the mentioned lamp-tubes 6 could be fluorescent tubes or light-emitting diode lamp-tubes.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the

What is claimed is:

1. A lamp holder structure for lamp-tubes in serial connections, the lamp holder structure assembled with a lamp-tube having conducting terminals and including:

a base body including a via hole, the via hole including a longitudinal opening;

two electrode plates arranged inside the base body, the electrode plate including at least a first contact part around the via hole;

a rotary shaft including a barrier plate, the barrier plate having a shaft part in the via hole, the shaft part and the barrier plate having a longitudinal gap; and a short-circuit part assembled with the shaft part, wherein the conducting terminals of the lamp-tube are arranged in the longitudinal gap through the longitudinal opening; the shaft part of the rotary shaft is rotated by rotating the lamp-tube, so that the conducting terminals of the lamp-tube are electrically contacted with the two first contact parts;

wherein before rotating the lamp-tube, the short-circuit part is electrically contacted with the two electrode plates; after rotating the lamp-tube, the short-circuit part is electrically contacted with one of the two electrode plates, and wherein the electrical connection between the two electrode plates is achieved by the lamp-tube; after rotating the lamp-tube again, the short-circuit part is electrically contacted with the two electrode plates, so that the two electrode plates are electrically contacted, and the power is transmitted to the next lamp holder structure.

2. The lamp holder structure in claim 1, wherein the base body includes a bottom part; a housing is extended from the bottom part; the housing includes a round junction area; the junction area is arranged around the via hole.

3. The lamp holder structure in claim 2, wherein a plurality of longitudinal and lateral convex rib sheets, which are used to fix the two electrode plates, and a junction part are arranged inside the housing and below the via hole.

4. The lamp holder structure in claim 3, wherein the first contact part is round; a first extension part is extended from the first contact part; a second extension part inclined to the first extension part, the second extension part extended and bent from the first extension part.

5. The lamp holder structure in claim 4, wherein a conjunction part is in the shaft part; the conjunction part includes a pass-through hole; the shaft part is passed through by the pass-through hole; the shaft part includes a lateral gap; two symmetric and half-round convex parts are inside the shaft part.

6. The lamp holder structure in claim 5, wherein the short-circuit part is a semicircle arc sheet body.

7. The lamp holder structure in claim 6, wherein the short-circuit part includes a locking part, which is locked to the longitudinal gap of the shaft part; each side of the short-circuit part is a buckling part; the buckling parts are buckled to the lateral gap of the shaft part.

8. The lamp holder structure in claim 7, further including a cover covering the housing, wherein the cover includes a convex block; the convex block includes an undulating edge part; the rotary shaft is assembled with the cover through the via hole; the convex part of the rotary shaft is on the edge part.

9. The lamp holder structure in claim 8, wherein a pivot axis is on the convex block; a convex-wall part in front of the pivot axis is in the conjunction part after the pass-through hole of the shaft part is passed through by the pivot axis.

10. The lamp holder structure in claim 9, wherein the cover includes at least a detent part and a fastening part; the detent part is used to detent the two first extension parts of the two electrode plates when the cover is assembled with the housing; the fastening part is used to fasten to the junction part.

11. The lamp holder structure in claim 10, wherein the lamp-tube is a light-emitting diode lamp-tube or a fluorescent tube.

* * * * *